US009377194B2

(12) United States Patent
Kim

(10) Patent No.: US 9,377,194 B2
(45) Date of Patent: Jun. 28, 2016

(54) SCRUBBER

(71) Applicant: Jin Il Kim, Gyeonggi-do (KR)

(72) Inventor: Jin Il Kim, Gyeonggi-do (KR)

( * ) Notice: Subject to any disclaimer, the term of this patent is extended or adjusted under 35 U.S.C. 154(b) by 264 days.

(21) Appl. No.: 13/714,378

(22) Filed: Dec. 13, 2012

(65) Prior Publication Data

US 2013/0305970 A1 Nov. 21, 2013

(30) Foreign Application Priority Data

May 21, 2012 (KR) ..... 10-2012-0053853

(51) Int. Cl.
*F23G 7/06* (2006.01)
*H05B 7/00* (2006.01)

(52) U.S. Cl.
CPC *F23G 7/065* (2013.01); *H05B 7/00* (2013.01); *F23C 2900/9901* (2013.01); *F23G 2204/201* (2013.01); *F23G 2209/142* (2013.01)

(58) Field of Classification Search
CPC ..... C25B 1/04–1/12; H05B 7/00; F23C 900/9901; F23G 7/065; F23G 2204/201; F23G 2209/142
See application file for complete search history.

(56) References Cited

U.S. PATENT DOCUMENTS 2,402,834 A * 6/1946 Nachtman ..... 205/142
3,304,460 A * 2/1967 Cargill, Jr. et al. ..... 314/21
3,480,805 A * 11/1969 Yerrell ..... 310/11
3,840,750 A * 10/1974 Davis et al. ..... 422/186.25
4,031,424 A * 6/1977 Penfold et al. ..... 204/192.12
4,080,431 A * 3/1978 Moss ..... 423/289
5,073,193 A * 12/1991 Chaklader et al. ..... 75/346
2010/0270142 A1* 10/2010 Kong ..... B01J 19/088 204/173
2011/0281959 A1* 11/2011 DiMascio et al. ..... 518/704

FOREIGN PATENT DOCUMENTS

KR 20-2000-0020450 U 12/2000
KR 10-2001-0017795 A 3/2001
KR 1020010017795 A * 5/2001 ..... B01D 53/00
KR 10-2002-075513 A 10/2002
KR 10-0784413 B1 12/2007
KR 10-0788412 B1 12/2007
KR 10-2009-0014687 A 2/2009

* cited by examiner

*Primary Examiner* — Ciel Thomas
(74) *Attorney, Agent, or Firm* — IP Legal Services, LLC

(57) ABSTRACT

A scrubber includes: a first body for burning toxic gas introduced into a combustion chamber, using a flame generated by a cathode electrode and an anode electrode, and auxiliary gases including hydrogen and oxygen; a second body which is connected with the first body and serves to induce complete combustion of the burned toxic gas in an in-chamber and indirectly cool the toxic gas; and an electrolysis unit serving to produce hydrogen and oxygen by electrolysis and supply the produced hydrogen and oxygen as auxiliary gases to the first body. In the scrubber, a high combustion rate can be achieved even at relatively low power by a combination of high energy, obtained by the combustion of hydrogen and oxygen, with combustion heat caused by plasma, and toxic gas can be more efficiently treated by increasing treatment temperature.

8 Claims, 8 Drawing Sheets

SCRUBBER

CROSS REFERENCE TO PRIOR APPLICATIONS

The present application claims priority under 35 U.S.C. §119 to Korean Patent Application No. 10-2012-0053853 (filed on May 21, 2012), which is hereby incorporated by reference in its entirety.

BACKGROUND OF THE INVENTION

1. Field of the Invention

The present invention relates to a scrubber, and more particularly, to a plasma scrubber for burning toxic gas using plasma in combination with hydrogen and oxygen, which are produced by electrolysis.

2. Description of the Prior Art

The use of toxic gases has increased with industrialization, and techniques or apparatuses for treating toxic gases have been developed. Particularly, toxic gases which are generated during the production of large amounts of products such as semiconductor devices or flat panel displays are generally treated by combustion apparatuses in which they are burned with plasma.

The plasma combustion apparatus is an apparatus of burning toxic gas by the interaction of a cathode and an anode, and the toxic gas burned in the combustion apparatus is then discharged after separate treatment.

However, the above-described plasma scrubber according to the prior art has the following disadvantages described below.

The plasma combustion apparatus is ideal in that fewer byproducts are generated, but it has a problem in that power consumption increases rapidly with an increase in the flow rate of the gas being treated.

Moreover, in the conventional method, nitrogen must be used to dilute the concentration of toxic gas.

In addition, when a pipeline for supplying an auxiliary gas such as hydrogen or oxygen is used, there is a problem in that the risk of fire or explosion increases, because it is difficult to control the supply of hydrogen or oxygen at a constant level.

SUMMARY OF THE INVENTION

Accordingly, the present invention has been made in view of the above-described problems occurring in the prior art, and it is an object of the present invention to reduce the increase of power consumption resulting from an increase in the flow rate of the gas being treated.

Another object of the present invention is to provide a combustion apparatus for supplying auxiliary gases capable of increasing treatment temperature.

In accordance with a preferred exemplary embodiment of the present invention, a scrubber of the present invention includes a main unit including: a first body for burning toxic gas using a flame generated by a cathode electrode and an anode electrode, and auxiliary gases; and a second body which is connected with the first body and includes an in-chamber for treating the toxic gas burned in the first body.

The scrubber of the present invention preferably includes an electrolysis unit serving to produce hydrogen and oxygen by the electrolysis of water and to supply the produced hydrogen and oxygen as auxiliary gases to the main unit.

Preferably, the second body includes a plurality of middle chambers located around the in-chamber, and a movement pathway is formed in the plurality of middle chambers such that the toxic gas introduced through the in-chamber is discharged to the bottom of the second body through the plurality of middle chambers.

The electrolysis unit of the present invention preferably includes: an electrolysis tank including a first electrode and a second electrode; a power supply unit for supplying power to the electrolysis tank; and a stabilizer for stabilizing gases produced in the electrolysis tank.

Preferably, the first electrode is made of a titanium metal, and the second electrode is made of a cold-rolled stainless steel metal.

The cathode electrode that is used in the scrubber of the present invention preferably includes a tungsten portion provided at the front end of the cathode electrode, and a copper portion connected to the tungsten portion and having a cooling water channel formed therein, in which the tungsten portion is screw-coupled with the copper portion such that it does not come in contact with cooling water flowing through the cooling water channel of the copper portion.

The anode electrode that is used in the scrubber of the present invention preferably includes: a first anode electrode which is provided in the first body and into which a plasma-forming gas introduced into the first body is introduced; and a second anode electrode which is connected with the first anode electrode and has a magnetic portion provided on the inner circumference thereof and in which a reaction chamber for generating a flame by plasma is provided at the central portion.

The first anode electrode of the present invention preferably includes: a flange portion inside which the cathode electrode is located at the center and at the circumference of which is formed plasma-forming gas inlet holes through which the plasma-forming gas is introduced; and an electrode body which communicates with the flange portion and is connected with the second anode electrode and at the circumference of which a cooling water channel is formed.

A dual chamber structure in a scrubber for treating waste gas according to the present invention preferably includes an in-chamber for burning toxic gas using a flame generated by a cathode electrode and an anode electrode, and auxiliary gases.

The dual chamber structure in the scrubber of the present invention preferably further includes a plurality of middle chambers configured such that they are located around the in-chamber and communicate with the in-chamber so as to discharge the toxic gas to the outside while maintaining a heat source.

DETAILED DESCRIPTION OF THE INVENTION

Additional advantages and features of the present invention will be more clearly understood from the following description and the accompanying drawings.

Hereinafter, a preferred embodiment of the present invention will be described in further detail with reference to the accompanying drawings.

FIGS. 1 to 10 show a preferred embodiment of a scrubber according to the present invention.

The scrubber of the present invention is configured such that it burns toxic gas by using auxiliary gases such as hydrogen and oxygen, which are supplied from an electrolysis unit, whereby combustion heat caused by plasma is used in combination with high energy generated by the combustion of hydrogen and oxygen, thereby reducing power consumption and treatment temperature.

Figure 1:
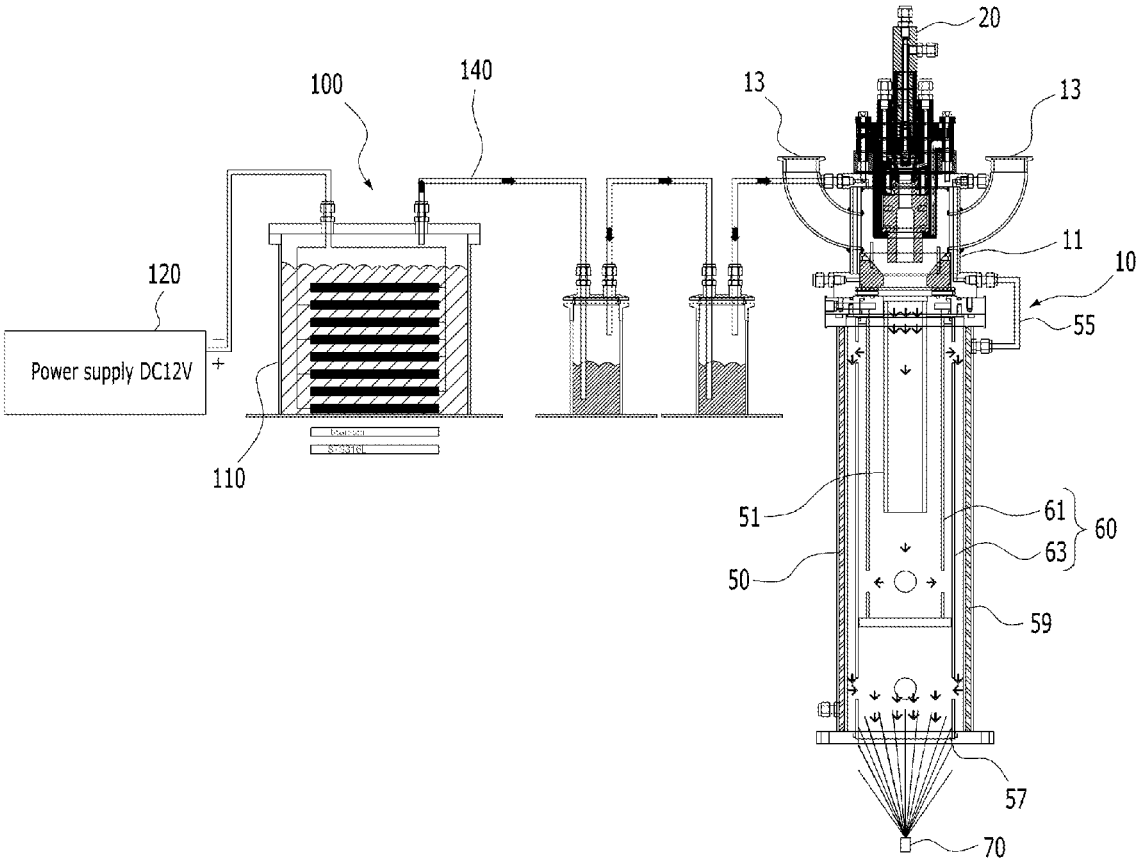
FIG. 1 is a cross-sectional view showing a preferred embodiment of a scrubber according to the present invention.

As shown in FIG. 1, the scrubber of the present invention comprises a main unit 10 for burning toxic gas. The main unit comprises a first body 11 for burning toxic gas by the interaction of a cathode electrode and an anode electrode.

To the side of the first body 11 there is connected an inlet pipe 13 through which toxic gas is introduced from the outside. Toxic gas that is introduced from the outside through the inlet pipe 13 may be introduced into the body 11. The inlet pipe 13 may be formed spirally so as to form an eddy of toxic gas.

The top of the first body 11 is provided with an insulating cap 15 (see FIG. 3) for closing the top of the first body 11, and the insulating cap 15 includes a tig setup 20 including a cathode electrode 27 whose length is vertically adjustable.

Figure 4:
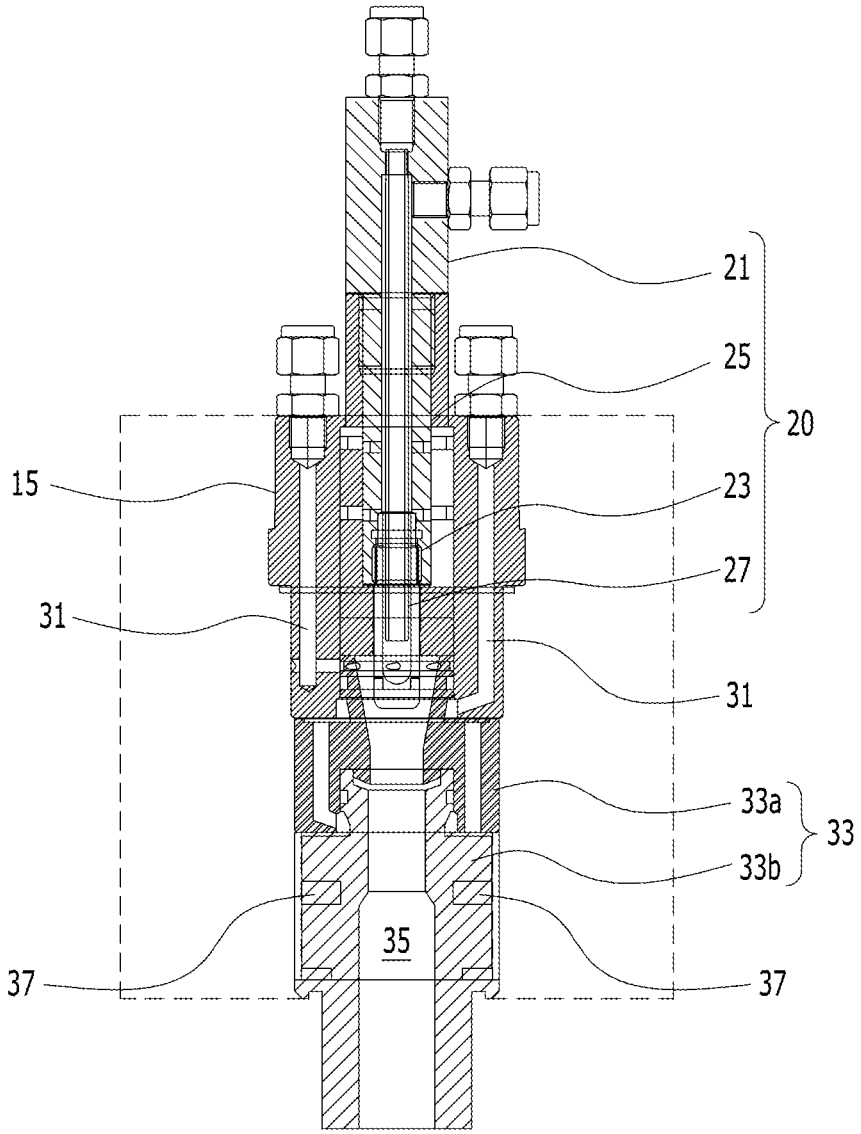
FIG. 4 is a cross-sectional view showing a tig setup in the scrubber according to the present invention.

The tig setup 20 functions to allow the cathode electrode 27 and an anode electrode 33 to react with each other by way of power supplied from the outside. As shown in FIG. 4, the tig setup 20 comprises a tig body 21 inserted in the insulating cap 15, and the tig body 21 includes an electrode chuck 23 connected with the cathode electrode 27.

At the point at which the tig body 21 is connected with the first body 11, there is provided a cathode electrode control unit 25 for controlling the protrusion length of the cathode electrode 27. The cathode electrode control unit 25 is screw-coupled to a thread formed on the inside of the first body 11. Thus, when the tig body 21 is rotated, the protrusion length of the cathode electrode 27 connected to the electrode chuck 23 of the tig body 21 can be controlled.

In other words, when the cathode electrode 27 is worn out so as to be spaced apart from the anode electrode 33 so that ignition is not easily initiated, the distance of the cathode electrode 27 from the anode electrode 33 can be adjusted by controlling the length of the cathode electrode 27 without having to replace the cathode electrode 27.

Figure 6:
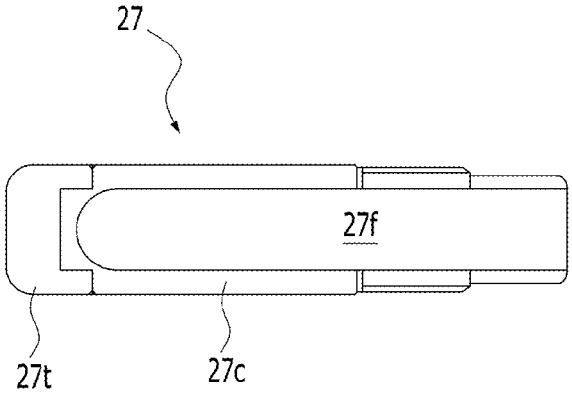
FIG. 6 is a cross-sectional view showing a cathode electrode in the scrubber according to the present invention.

FIG. 6 shows the detailed structure of the cathode electrode 27. Generally, a cathode electrode according to the prior art is divided into a tungsten portion and a copper portion, and the tungsten portion and the copper portion are formed to be coupled to each other. Also, the cathode electrode according to the prior art is configured such that cooling water flows in the center inside the tungsten portion and the copper portion.

However, in the cathode electrode according to the prior art, the tungsten portion came in direct contact with water. Thus, in some cases, the tungsten portion was damaged or spaced apart from the anode electrode such that electric discharge did not occur. To solve this problem, the cathode electrode 27 according to the present invention is configured such that water comes in contact only with the copper portion.

As shown in FIG. 6, the cathode electrode 27 is divided into a tungsten portion 27*t* and a copper portion 27*c* and configured such that the tungsten portion 27*t* is screw-coupled with the copper portion 27*c*.

A cooling water channel 27*f* is formed in the copper portion 27*c* so that cooling water moves through the cooling water channel 27*f* to cool the cathode electrode 27. Herein, the tungsten portion 27*t* is preferably formed at the end portion of the copper portion 27*c* so that it does not come in direct contact with cooling water.

Each of the tungsten portion 27*t* and the copper portion 27*c* may be formed in a rod shape having a diameter of about 12 mm. The tungsten portion 27*t* may be formed to have a length of about 8 mm, and the copper portion may be formed to have a length of about 52 mm.

Furthermore, the tungsten portion 27*t* and the copper portion 27*c* are screw-coupled to each other, and after screw coupling, they are welded to each other in order to improve heat transfer. In addition, the cooling water channel 27*f* which is formed in the copper portion 27*c* may be formed to have a width of about 7.5 mm and a depth of about 44 mm.

The front end of the cathode electrode 27 configured as described above is made of tungsten having high heat resistance, and the back end is made of copper having good heat conductivity, whereby the heat resistance and electric discharge effects of the cathode electrode 27 can be maximized. Further, because the cooling water channel is formed only in the copper portion 27*c*, the tungsten can be prevented from being damaged by water.

In addition, in the insulating cap 15 in which the cathode electrode 27 is placed, a plasma-forming gas channel 31 (see FIG. 4) for introducing a plasma-forming gas into the first body 11 is formed. A plasma-forming gas, such as nitrogen, introduced through the plasma-forming gas channel 31, generates a flame by the interaction of the cathode electrode 27 and the anode electrode 33.

Below the insulating cap 15, there is formed a reaction chamber 35 that provides a space in which the cathode electrode 27 and the anode electrode 33 react with each other. Around the reaction chamber 35, there is provided the anode electrode 33 that reacts with the cathode electrode 27.

For high voltage and low power, the anode electrode 33 is divided into two stages: a first anode electrode 33*a* and a second anode electrode 33*b*. The first anode electrode 33*a* and the second anode electrode 33*b* are coupled to each other.

Figure 7:
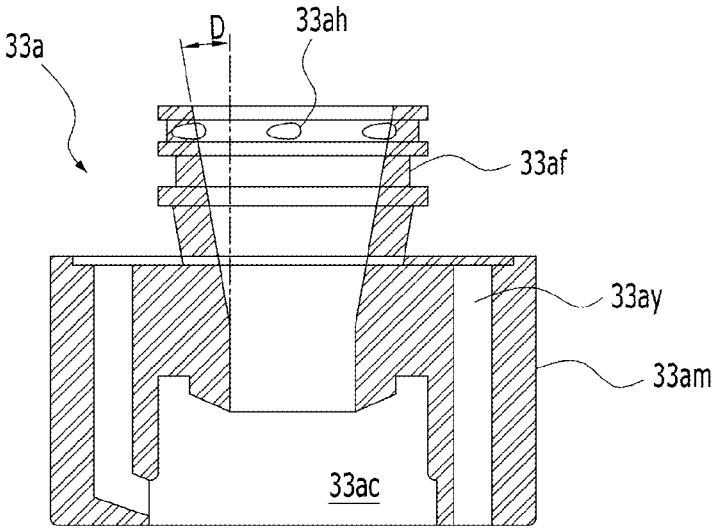
FIG. 7 is a cross-sectional view showing a first anode electrode in the scrubber according to the present invention.
Figure 8:
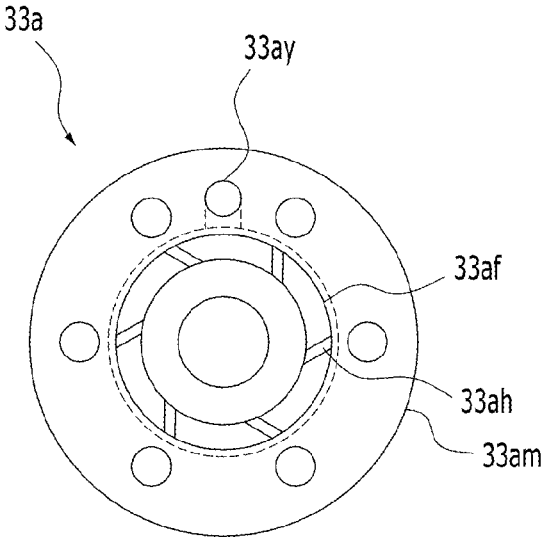
FIG. 8 is a top view of the first anode electrode shown in FIG. 7.

As shown in FIG. 7, the first anode electrode 33*a* forming the upper portion of the anode electrode 33 comprises a flange portion 33*af* and an electrode body 33*am*. At the circumference of the flange 33*af*, there are formed plasma-forming gas inlet holes 33*ah* which are connected to the plasma-forming gas channel 31 so as to introduce the plasma-forming gas into the anode electrode 33. As shown in FIG. 8, the plasma-forming gas inlet holes 33*ah* are preferably formed so as to extend in the slant line direction.

Further, the center inside the flange portion 33*af* is formed to be perforated. Preferably, the inner circumferential surface of the flange portion 33*af* is tapered downward at an angle of about 9-12°.

Due to the tapered angle of the inner circumferential surface of the flange portion 33*af*, a plasma-forming gas which is introduced through the plasma-forming gas inlet holes 33*ah* forms an eddy while it is introduced consistently into the flange portion 33*af*. In addition, in the center inside the flange portion 33*af*, there is placed the end of the cathode electrode 27 that reacts with the anode electrode 33.

As shown in FIG. 8, the electrode body 33*am* includes cooling water channels 33*ay* which extend in the vertical direction. The cooling water channels 33*ay* may be formed along the circumference of the electrode body 33*am* at specific intervals.

As shown in FIG. 7, at the lower portion of the electrode body 33*am*, there is a formed an insertion chamber 33*ac* into which the second anode electrode 33*b* is inserted and which communicates with the portion inside the flange portion 33*af*.

Figure 9:
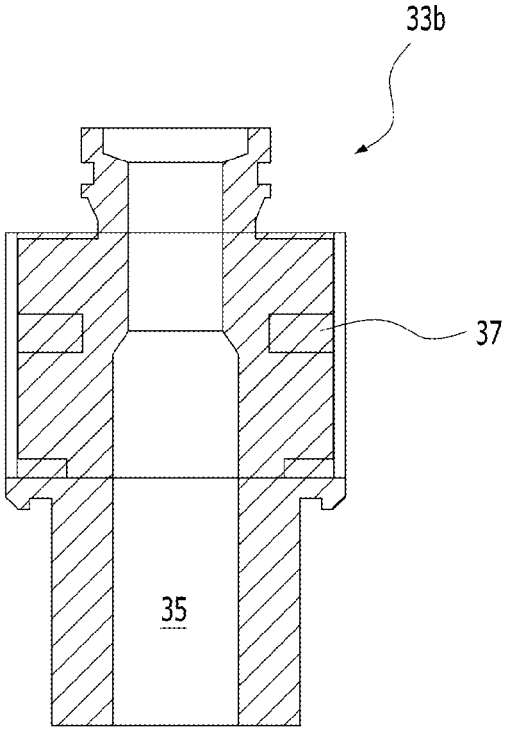
FIG. 9 is a cross-sectional view showing a second anode electrode in the scrubber according to the present invention.

As shown in FIG. 9, the second anode electrode 33*b* which is inserted into the insertion chamber 33*ac* includes a reaction chamber 35 extending therethrough, and at the circumference of the reaction chamber 35, there may be provided magnetic portions 37 for forming an eddy by a flame generated by the cathode electrode 27 and the anode electrode 33.

Figure 10:
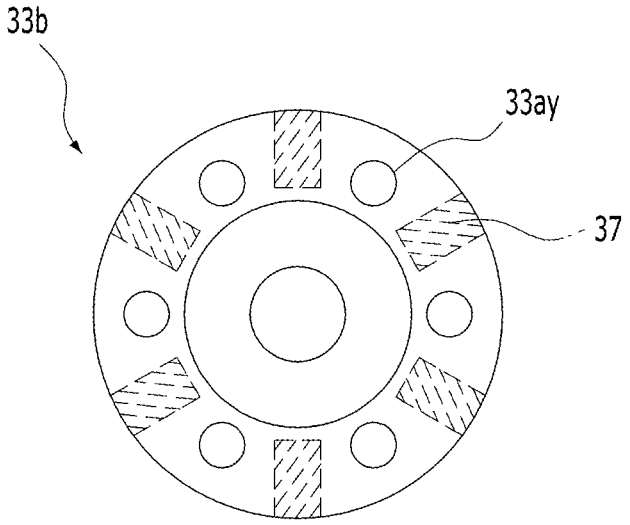
FIG. 10 is a top view of the second anode electrode shown in FIG. 9.

As shown in FIG. 10, six magnetic portions may be arranged spirally at regular intervals. The magnetic portions 37 are preferably symmetrical spirally so that a flame in the anode electrode 22 is uniformly applied downward.

Below the reaction chamber 35, there is formed a combustion chamber 39 in which toxic gas is burned. Toxic gas introduced through the inlet pipe 13 is burned in the combustion chamber 39.

To the first body 11 to which the inlet pipe 13 is connected, there is connected an auxiliary gas pipe 40 through which auxiliary gases are introduced from an electrolysis unit 100 to be described below. Auxiliary gases such as hydrogen and oxygen are introduced through the auxiliary gas pipe 40 to promote the combustion of toxic gas in the combustion chamber 39.

To the lower side of the first body 11, there is connected a second body 50 for burning toxic gas by a flame and cooling the burned toxic gas or removing toxic substances from the toxic gas.

Figure 2:
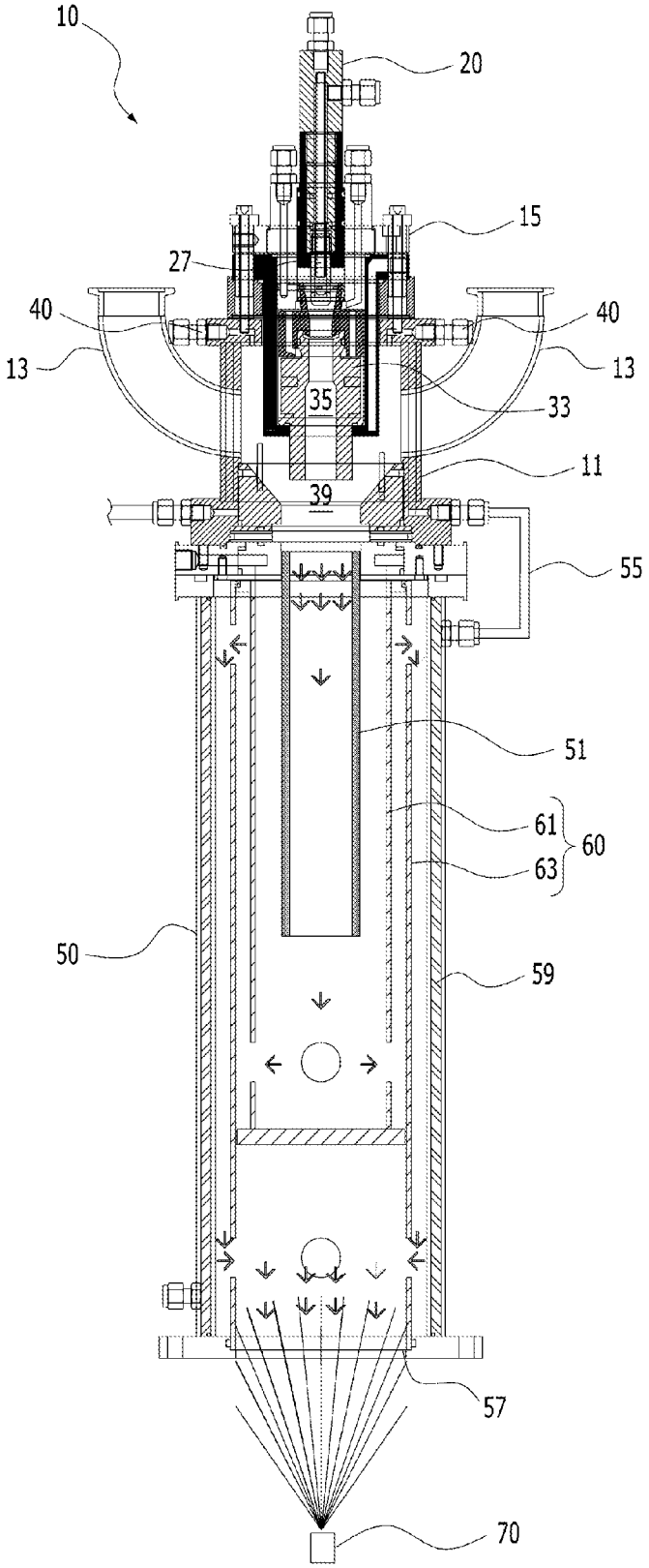
FIG. 2 is a cross-sectional view showing a main unit in the scrubber according to the present invention.
Figure 3:
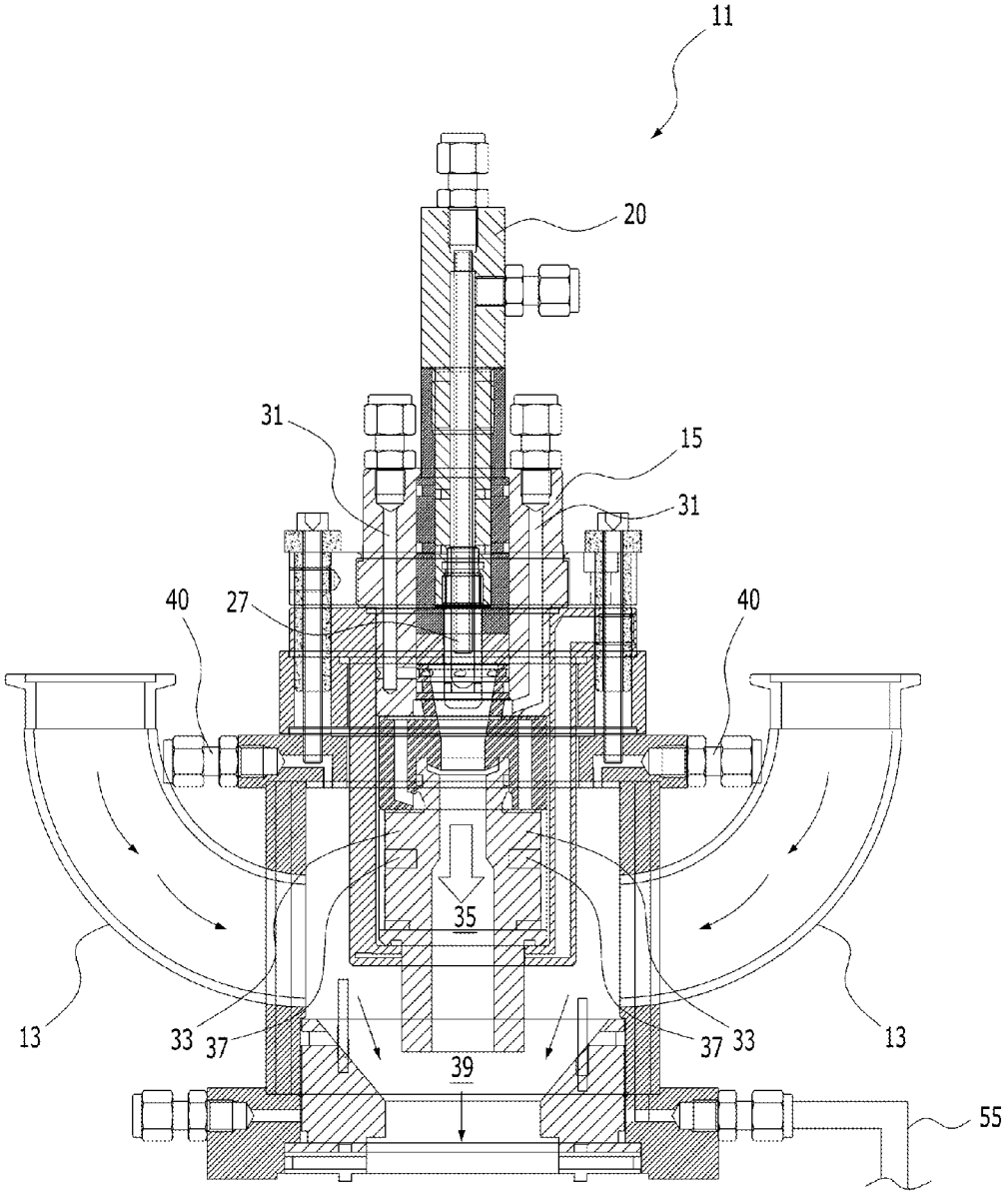
FIG. 3 is a cross-sectional view showing a first body in the scrubber according to the present invention.

As shown in FIG. 2, to the inner center of the second body 50, there is connected an in-chamber 51 which communicates with the combustion chamber 39. The in-chamber 51 extends downward from the top to the middle portion of the second body 50.

The in-chamber 51 is provided in the second body 50 to form a dual chamber. Toxic gas burned in the first body 11 is additionally burned in the in-chamber 51. Because the entire chamber consists of a dual chamber due to the in-chamber 51, a plasma flame can be cooled indirectly and can move downward.

Between the second body 50 and the in-chamber 51, there may be provided a plurality of middle chambers 60. The middle chambers 60 serve to increase the length of the movement pathway of toxic gas which is burned in the in-chamber 51, thereby completely burning the toxic gas and reducing the discharge of the toxic gas.

As shown in FIG. 2, the middle chambers 60 may consist of a first middle chamber 61 and a second middle chamber 63. The first middle chamber 61 which surrounds the in-chamber 51 is closed at the bottom, and a portion of the side thereof is open so as to communicate with the second middle chamber 63. Thus, toxic gas in the first middle chamber 61 can move to the second middle chamber 63.

The second middle chamber 63 surrounds the first middle chamber 61. A portion of the upper portion of the second middle chamber 63 communicates with the first middle chamber 61, and a portion of the lower portion communicates with the portion below the first middle chamber 61, that is, the lower portion of the second body 50.

Toxic gas introduced into the bottom of the second middle chamber 63 is discharged to an external water tank (not shown) through an outlet 57 provided at the bottom of the second body 50.

On the outermost surface of the second body 50, a cooling chamber 59 for cooling the outer surface of the second body 50 may be provided. The cooling chamber 59, through which cooling water introduced through a cooling water pipe 55 from the outside flows, serves to cool the outer surface of the second body 50.

Below the second body 50, there may be provided a water treatment unit 70 for removing toxic substances from toxic gas which is discharged through the outlet 57. The water treatment unit 70 may be connected with the bottom of the second body 50 and may be connected with an external water tank.

The water treatment unit 70 serves to spray water upward toward the second body 50 so as to remove toxic substances from toxic gas.

Toxic gas passed through the second body 50 is discharged through the outlet 57 provided at the bottom of the second body 50 and is received in a water tank, after which it is treated by a separate additional treatment apparatus or exhaust apparatus.

The main unit 10 configured as described above is connected with an electrolysis unit 100 which generates hydrogen and oxygen by electrolysis and supplies the generated hydrogen and oxygen as auxiliary gases. Hydrogen and oxygen which are produced in the electrolysis unit 100 are introduced into the main unit through an auxiliary gas pipe 40.

Hydrogen and oxygen which are produced by the electrolysis of water in the electrolysis unit 100 are supplied as auxiliary gases, and high energy generated by combustion of hydrogen and oxygen acts in combination with combustion heat caused by plasma, thereby increasing treatment temperature and reducing power consumption.

Figure 5:
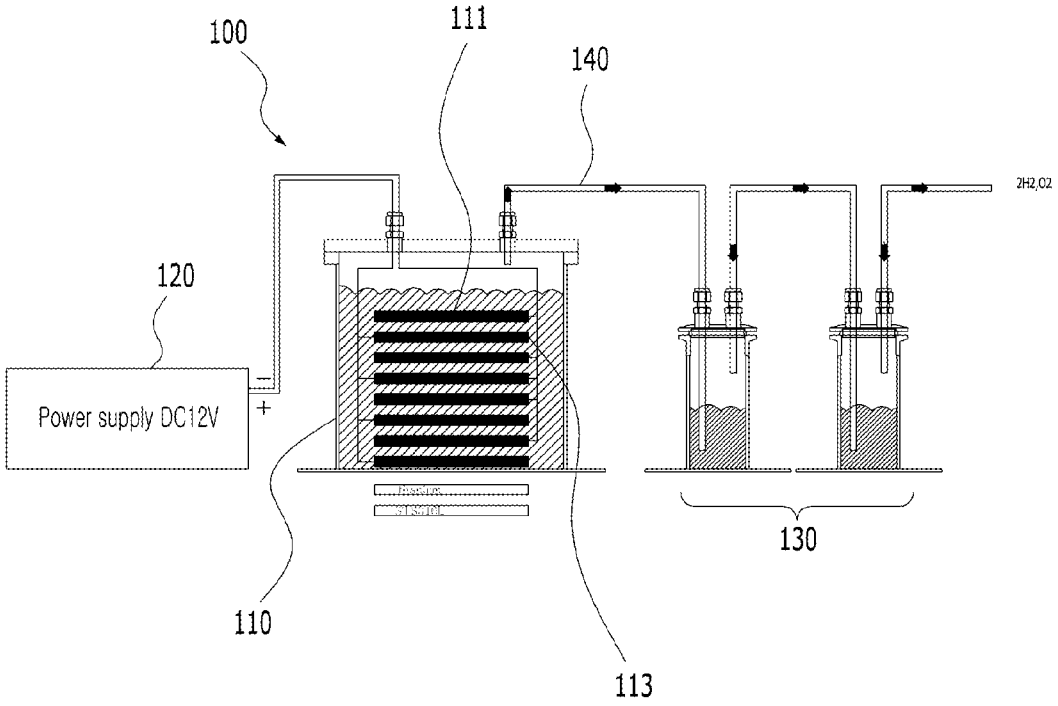
FIG. 5 is a cross-sectional view showing an electrolysis unit in the scrubber according to the present invention.

As shown in FIG. 5, the electrolysis unit 100 comprises an electrolysis tank 110, a power supply unit 120 for supplying power to the electrolysis tank 110, and a stabilizer 130 for preventing the explosion of auxiliary gases such as hydrogen and oxygen, which are produced in the electrolysis tank 110.

The electrolysis tank 110 comprises a first electrode 111, which may be made of 99.7% titanium (Ti), and a second electrode 113 which may be made of a stainless steel metal. More specifically, the second electrode 113 is preferably made of STS316L as described in KSD 3698 (cold-rolled stainless sheet and wire).

The first electrode 111 and the second electrode 113 are spaced apart from each other at an interval of about 2 mm. When electric current is applied to the first electrode 111 and second electrode 113 filled with water, oxygen will be generated in the first electrode, and hydrogen will be generated in the second electrode 113.

In addition, hydrogen and oxygen which are generated in the electrolysis tank 110 move to a plurality of stabilizers 130 through transfer pipes 140. The stabilizers 130 serve to prevent explosion from occurring due to the generated hydrogen and oxygen and to supply the generated hydrogen and oxygen in a stable manner and functions as a flashback arrestor.

The stabilizers 130 are configured such that the transfer pipe 140 extending from the electrolysis tank 110 is immersed in water in the stabilizer 130 and the other transfer pipe 140 is not immersed in water. Thus, hydrogen and oxygen which are generated in the electrolysis tank 110 are supplied to water so as to prevent explosion from occurring due to excessive concentration of hydrogen and oxygen. Hydrogen and oxygen, dispersed into air from water in the stabilizer 130, move to the next stabilizer 130, and thus a stable supply of hydrogen and oxygen is possible.

Hydrogen and oxygen, passed through the stabilizers 130, are supplied to the main unit 10 in which they are used as auxiliary gases for burning toxic gas, thereby reducing power consumption and increasing treatment temperature.

A titanium metal and a cold-rolled stainless steel metal, which are used in the electrolysis tank 110 for the generation of hydrogen and oxygen, have high electrolysis ability, and thus can resolve the financial issues resulting from the use of platinum or stainless steel according to the prior art.

For example, when a power supply unit 120 that outputs a DC voltage of 12 V using alternating current is used, about 1 LPM of hydrogen and oxygen can be generated from water which is electrolyzed by a DC voltage of 12 V and a current of 20 A. Tables 1 to 3 below show efficiency as a function of power consumption in the case in which such hydrogen and oxygen are used as auxiliary gases.

TABLE 1

| Gas name | $N_2$ flow rate (LPM) | Concentration (PPM) | Efficiency (%) | Power (Kw) |
|---|---|---|---|---|
| $NF_3$ | 200 | 1,000 | 95 | 22 |
| | | 5,000 | 96 | |
| | | 10,000 | 98 | |
| $CF_4$ | 100 | 100 | 90 | 22 |
| | | 1,000 | 90 | |
| | | 5,000 | 90 | |

(Efficiency as a function of power consumption in a conventional method which does not use electrolysis or a multiple chamber)

TABLE 2

| Gas name | $N_2$ flow rate (LPM) | Concentration (PPM) | Efficiency (%) | Power (Kw) |
|---|---|---|---|---|
| $NF_3$ | 300 | 1,000 | 97.7 | 14 |
| | | 5,000 | 98 | |
| | | 10,000 | 98.6 | |
| $CF_4$ | 100 | 100 | 98.5 | 14 |
| | | 1,000 | 96.7 | |
| | | 5,000 | 96.8 | |

(Efficiency at a power of 14 Kw in the present invention)

TABLE 3

| Gas name | $N_2$ flow rate (LPM) | Concentration (PPM) | Efficiency (%) | Power (Kw) |
|---|---|---|---|---|
| $CF_4$ | 200 | 100 | 91 | 18 |
| | | 1,000 | 92 | |
| | | 5,000 | 92 | |

(Efficiency at a power of 14 Kw in the present invention)

As can be seen in Tables 1 to 3 above, power consumption in the present invention is 14 Kw corresponding to 63% of that in the conventional method, and the method of the present invention can treat 90% or more of 200 LPM of $CF_4$ gas at a power of 18 Kw.

In addition, Table 4 below shows treatment efficiency as a function of the usage of auxiliary gases (CDA) such as hydrogen and oxygen, and Table 5 below shows chamber temperature as a function of DC voltage.

TABLE 4

| DC (V) | 258 | 258 | 258 |
|---|---|---|---|
| CD (A) | 0 | 5 | 10 |
| N2 (LPM) | 100 | 100 | 100 |
| Power (Kw) | 13.5 | 13.5 | 13.5 |
| Input (ppm) | 965 | 1,051 | 942 |
| Output (ppm) | 301 | 22.6 | 41.7 |
| Efficiency (%) | 58 | 97 | 95.2 |

TABLE 5

| Power (Kw) | DC (V) | Chamber temperature (° C.) |
|---|---|---|
| 12 | 130 | 1,200 |
| | 200 | 1,400 |
| | 240 | 1,600 |

From the results in Table 4 above, efficiencies obtained when the auxiliary gases are used in amounts of 0 LPM, 5 LPM and 10 LPM can be seen. As can be seen in Table 5 above, an increase in DC voltage leads to an increase in chamber temperature.

Although Table 4 above describes that the auxiliary gases are supplied in an amount of 0-10 LPM, the auxiliary gases may preferably be supplied in an amount of 5-20 LPM.

The reaction of carbon tetrafluoride ($CF_4$), a toxic gas, in the scrubber configured as described above, occurs according to the following reaction formula 1.

$$CF_4+H_2+O_2 \rightarrow CO_2+2HF_2 \qquad \text{Reaction formula 1}$$

$H_2$ and $O_2$, which are required to treat $CF_4$, are obtained at a temperature of 3,000° C. or higher, and high power needs to be maintained in order to obtain this temperature. However, in the scrubber of the present invention, toxic gas such as $CF_4$ can be treated with low power, because the toxic gas is treated by introducing hydrogen and oxygen, generated by electrolysis, into the chamber.

As described above, in the scrubber of the present invention, a high combustion rate can be achieved even with relatively low power by a combination of high energy, obtained by the hydrogen and oxygen produced by electrolysis, with the combustion heat caused by plasma.

In addition, according to the present invention, toxic gas can be more efficiently treated by supplying hydrogen and oxygen to increase treatment temperature.

Because $H_2$ and $O_2$ which are required to treat $CF_4$ gas are obtained at high temperature, high power needs to be maintained in order to obtain this temperature. However, in the scrubber of the present invention, $CF_4$ can be easily treated with low power, because the hydrogen and oxygen generated by electrolysis are used.

Although the preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A scrubber comprising:

a main unit comprising:

a first body for burning toxic gas using a flame generated by a cathode electrode and an anode electrode, and auxiliary gases; and a second body which is configured to be connected with the first body and includes (i) an in-chamber for treating the toxic gas burned in the first body and (ii) a plurality of middle chambers sequentially surrounding a wall of the in-chamber in a multi-layer structure, wherein (a) each of the plurality of middle chambers is formed by a cylindrical wall, wherein each of the cylindrical walls for the plurality of middle chambers has a different diameter from other cylindrical walls for the plurality of middle chambers, and (b) the plurality of middle chambers are formed in the multi-layer structure such that the in-chamber and one of the plurality of middle chambers having a relatively lesser diameter are positioned inside one of the plurality of middle chambers having a relatively greater diameter; and an electrolysis unit configured to produce hydrogen and oxygen by electrolysis of water and to supply the produced hydrogen and oxygen as the auxiliary gases to the main unit, wherein the plurality of middle chambers are configured to form a movement pathway for the toxic gas such that the toxic gas introduced through the in-chamber is discharged to a bottom of the second body through the plurality of middle chambers;

wherein the movement pathway is formed by forming at least one opening portion on the cylindrical wall of each of the plurality of middle chambers such that each of the plurality of middle chambers communicates with a neighboring one of the plurality of middle chambers or the in-chamber through the at least one opening portion; and wherein the at least one opening portion of each of the plurality of middle chambers is formed at one of an upper position and a lower position of the cylindrical wall of each of the plurality of middle chambers according to a layer sequence of a corresponding one of the plurality of middle chambers such that the opening portions of the plurality of middle chambers are arranged in an alternating pattern to form the movement pathway including at least one upward flow path and at least one downward flow path.

2. The scrubber of claim 1, wherein the electrolysis unit comprises:

an electrolysis tank including a first electrode and a second electrode;

a power supply unit for supplying power to the electrolysis tank; and a stabilizer for stabilizing the hydrogen and oxygen produced in the electrolysis tank.

3. The scrubber of claim 2, wherein the first electrode is made of a titanium metal, and the second electrode is made of a cold-rolled stainless steel metal.

4. The scrubber of claim 1, wherein the cathode electrode comprises:

a tungsten portion provided at a front end of the cathode electrode; and a copper portion connected to the tungsten portion and having a cooling water channel formed therein, in which the tungsten portion is screw-coupled with the copper portion such that it does not come in contact with cooling water flowing through the cooling water channel of the copper portion.

5. A dual chamber structure in a scrubber for treating waste gas, the dual chamber structure comprising:

an in-chamber for burning toxic gas using a flame, generated by a cathode electrode and an anode electrode, and auxiliary gases, wherein the auxiliary gases are hydrogen and oxygen produced by electrolysis of water; and a plurality of middle chambers configured to sequentially surround a wall of the in-chamber in a multi-layer structure and to form a movement pathway for the toxic gas such that the toxic gas introduced through the in-chamber is discharged to an outside through the plurality of middle chambers, wherein (i) each of the plurality of middle chambers is formed by a cylindrical wall, wherein each of the cylindrical walls for the plurality of middle chambers has a different diameter from other cylindrical walls for the plurality of middle chambers, and (ii) the plurality of middle chambers are formed in the multi-layer structure such that the in-chamber and one of the plurality of middle chambers having a relatively lesser diameter are positioned inside one of the plurality of middle chambers having a relatively greater diameter;

wherein the movement pathway is formed by forming at least one opening portion on the cylindrical wall of each of the plurality of middle chambers such that each of the plurality of middle chambers communicates with a neighboring one of the plurality of middle chambers or the in-chamber through the at least one opening portion; and wherein the at least one opening portion of each of the plurality of middle chambers is formed at one of an upper position and a lower position of the cylindrical wall of each of the plurality of middle chambers according to a layer sequence of a corresponding one of the plurality of middle chambers such that the opening portions of the plurality of middle chambers are arranged in an alternating pattern to form the movement pathway including at least one upward flow path and at least one downward flow path.

6. The scrubber of claim 1, wherein the anode electrode comprises:

a first anode electrode which is provided in the first body and into which a plasma-forming gas introduced into the first body is introduced; and a second anode electrode which is configured to be connected with the first anode electrode and has a magnetic portion provided on an inner circumference thereof and in which a reaction chamber for generating the flame by plasma is provided at a central portion, wherein the first anode electrode has a hollow cylindrical shape to form a plasma-forming gas passage thereinside, and includes at least one plasma-forming gas inlet hole which is formed through a side of the first anode electrode such that the plasma-forming gas is introduced to the plasma-forming gas passage; and wherein the at least one plasma-forming gas inlet hole is formed in a slant direction with respect to a radial axis of the first anode electrode.

7. The scrubber of claim 6, wherein the first anode electrode comprises:

a flange portion inside which the cathode electrode is located at a center and at a circumference of which is formed the at least one plasma-forming gas inlet hole through which the plasma-forming gas is introduced; and an electrode body which is configured to communicate with the flange portion and to be connected with the second anode electrode, and at the circumference of which a cooling water channel is formed.

8. The scrubber of claim 2, wherein the stabilizer is configured to stabilize the produced hydrogen and oxygen by enabling the produced hydrogen and oxygen to pass through water.

* * * * *